US007484515B1

(12) United States Patent
Bluestone et al.

(10) Patent No.: US 7,484,515 B1
(45) Date of Patent: Feb. 3, 2009

(54) COMBINATION PARTS JET WASHER AND SINK WASHER

(76) Inventors: Ronald H. Bluestone, 955 Kiowa Ave., #E, Lake Havasu, AZ (US) 86403; Ryan J. Bluestone, 955 Kiowa Ave., #E, Lake Havasu, AZ (US) 86403

( * ) Notice: Subject to any disclaimer, the term of this patent is extended or adjusted under 35 U.S.C. 154(b) by 512 days.

(21) Appl. No.: 10/658,950

(22) Filed: Sep. 9, 2003

(51) Int. Cl.
*B08B 3/00* (2006.01)

(52) U.S. Cl. ..... 134/108; 134/104.1; 134/104.2; 134/131

(58) Field of Classification Search ..... 134/147, 134/148, 60, 137, 84, 92, 169 A, 170, 177, 134/110, 108, 82, 8, 4, 109, 111, 113, 85, 134/104.1, 104.2, 131, 135, 149
See application file for complete search history.

(56) References Cited

U.S. PATENT DOCUMENTS

| | | | | | |
|---|---|---|---|---|---|
| 1,395,728 | A | * | 11/1921 | Ormes | 217/89 |
| 2,579,393 | A | * | 12/1951 | Modrey | 4/654 |
| 2,680,802 | A | * | 6/1954 | Bremer et al. | 392/321 |
| 3,026,699 | A | * | 3/1962 | Rhodes | 68/12.19 |
| 3,514,330 | A | * | 5/1970 | Leedy et al. | 134/115 R |
| 4,128,478 | A | * | 12/1978 | Metzger | 210/167.01 |
| 4,776,359 | A | * | 10/1988 | Federighi et al. | 134/111 |
| 5,232,299 | A | | 8/1993 | Hiss | |
| 5,349,708 | A | * | 9/1994 | Lee | 4/638 |
| 5,368,053 | A | * | 11/1994 | Wilson | 134/95.2 |
| 5,409,308 | A | * | 4/1995 | Reuter et al. | 312/319.4 |
| 5,528,913 | A | * | 6/1996 | Savkar | 68/23.3 |
| 6,115,541 | A | * | 9/2000 | Rhodes | 392/441 |
| 6,306,221 | B1 | * | 10/2001 | Magliocca | 134/10 |
| 2005/0199267 | A1 | * | 9/2005 | Oakes | 134/10 |

OTHER PUBLICATIONS

Professional Tool & Equipment News, vol. 14, No. 4, May 2003; A Cygnus Publication, Published by Cygnus Business Media, Fort Atkins, Wisconsin, USA. pp. 30-33.

* cited by examiner

*Primary Examiner*—Michael Barr
*Assistant Examiner*—Rita R Patel
(74) *Attorney, Agent, or Firm*—Gregory J. Nelson

(57) ABSTRACT

A combination sink and jet parts washer for cleaning mechanical parts of oil, grease and contaminants. The washer has a cabinet which has a jet cleaning section and a reservoir. A parts receptacle in the jet cleaning section receives the parts which are cleaned by a spray from a spray manifold. The manifold is connected to a fluid pump which has its inlet communicating with the reservoir. A sink is positioned on the top of the cabinet and opens to access the jet washer and reservoir. In the closed position, the sink covers the top of the cabinet and may be used as a sink washer using the attached brush. In a preferred embodiment, the sink is hinged to the cabinet but may be a lift-off sink or may be on a track. The jet parts washer provides convenience, economy and the features of a sink and jet washer in a single, compact, mobile unit.

12 Claims, 4 Drawing Sheets

COMBINATION PARTS JET WASHER AND SINK WASHER

FIELD OF THE INVENTION

The present invention relates to an apparatus for washing articles and more particularly relates to a combination sink washer and jet washer apparatus for washing articles such as automotive parts to remove grease, oil and other contaminants, preferably using a washing fluid which consists of a non-solvent based, non-flammable, biodegradable and environmentally acceptable washing solution.

BACKGROUND OF THE INVENTION

Various types of parts washers are commonly used in machine shops, garages, automotive shops and the like for removing the grime, oil and contamination from parts. In the past, most parts washers of the sink type utilized toxic cleaning fluids such as petroleum-based solvents and non-biodegradable detergents. The use of such toxic cleaning solutions is environmentally objectionable and, as a result, both state and federal authorities have restricted or severely limited the uses of these types of solutions and solvents.

Accordingly, there developed a need for an environmentally acceptable parts washer which utilizes safe, biodegradable cleaning solutions and which are effective to remove accumulated grime, particularly hydrocarbon-based contaminants such as oil and grease.

One type of parts washer is the standard sink-type washer which uses a recirculated solvent which dispenses a cleaning solution at a nozzle or brush. The user will simply scrub the part with the brush and the solvent will assist in removing contaminants. Sink-type parts washers, since they are manual, may be messy and time-consuming in use.

Various sink-type washers can be found in the prior art, such as the ATEC Trans-Tool T-6010-AQ Aqueous Manual Sink Style Parts Washer. Cuda also has a portable, solvent-free manual parts washer.

These devices generally have a sink mounted on a housing which has a reservoir with an accessory such as a flow-through brush, spigot and drain strainer for catching parts. The parts are washed and the solvent flows through the drain into a fluid tank below the sink.

Automatic jet washers are another type of parts washers found in the industry. Generally these type of devices have a cabinet in which is located a spray system connected to a pump for delivering pressurized cleaning solution. A standard jet washer usually includes the cabinet, a basket or turntable on which the parts are to be cleaned and one or more spray manifolds.

Insta-Clean, Manufacturing of Lake Havasu City, Ariz., offers a line of degreasers and washers which include a cabinet. The Insta-Clean IC4 parts cleaner has a large load capacity for accommodating large parts such as transmission cases, engine blocks and the like. This machine is designed to use a non-flammable, biodegradable cleaning compound which is disbursed by a manifold in the cabinet.

Other types of parts washers are shown in the prior art. Reference is made to U.S. Pat. No. 5,232,299 which shows a recirculating parts washer which provides both automatic jet washing and manual sink-type brush washing for automotive parts and the like. The parts washer uses a water-based detergent cleaning solution. The housing provides an enclosed wash area, jet wash means providing automatic jet washing, a brush wash means allowing manual cleaning and a pump for delivering a flow of cleaning solution to the wash and brush means.

Thus, while the prior art suggests various types of parts washers including automatic parts washers, sink-type parts washers, jet washers and cabinet-style washers, there nevertheless exists the need for a versatile, economical parts washer which can be utilized as a parts washing sink and which can also be utilized as a jet wash.

BRIEF SUMMARY OF THE INVENTION

Briefly, the present invention relates to a versatile parts washer which uses a water-based, biodegradable detergent solution for cleaning and degreasing mechanical parts such as automotive parts. The washer can be utilized both as a parts washing sink as well as a jet washer and is efficient to use and compact and economical to manufacture. The invention is a combination unit which provides the benefits of a sink washer and a jet washer in a single, compact, mobile unit requiring minimal shop floor space.

The washer has a cabinet, which is preferably mobile, and is mounted on casters or wheels so it may easily be moved about in a shop. The cabinet may be any shape but is preferably square or rectangular and fabricated from steel suitably finished and insulated. The cabinet defines a reservoir, a mechanical enclosure and a jet washer compartment which contains electrical connections and other components. A heater is provided for maintaining the washing solution at a suitable temperature for effective contaminant removal. Safety controls, such as a low water level heater shutoff sensor, is located within the housing.

A basket for receiving parts to be washed is located within the housing and mounted for rotation in suitable bearings. The basket is foraminous and is rotatably driven in the upper part of the cabinet either by suction-induced fluid flow to the pump or by a suitably sealed gear motor which drives a pulley arrangement. The basket is disposed approximately 1" to 14" below the upper edge of the cabinet so that parts may be easily placed in the basket and removed once cleaned.

The pump has an inlet near the bottom of the housing which will deliver pressurized fluid to a manifold spray which directs pressurized fluid both vertically and horizontally for total coverage of the parts basket in the jet washer compartment.

The upper open end of the cabinet receives a parts sink which may be steel, stainless steel or other durable, chemical resistant material. The sink also serves as a lid or cover for the jet wash compartment in the cabinet. The sink is hinged to the cabinet so that it may be pivoted to the open position to access the interior of the cabinet. Preferably the sink is connected to the cabinet by a suitable mechanism such as a gas spring which will maintain the sink in the open position and dampen the return of the sink to the normal closed position overlying the cabinet.

The sink has a downwardly inclined bottom surface which directs fluid and contaminants to a central drain. The central drain discharges through a strainer. A baffle in the jet spray compartment deflects the jet spray so it does not discharge through the sink drain.

The present invention provides a versatile parts washer providing the combined features of both automatic and manual cleaning utilizing a water-based solution. In one mode of operation, the device is a portable parts washing sink. The cleaning solution is delivered to a brush via a hose and valve to regulate the flow. The parts washing sink can be utilized to clean smaller, less contaminated parts. The jet washer will normally be used to clean larger, more contaminated parts which makes the process more efficient. Small parts may also be washed and cleaned in the jet washer.

The parts can be automatically washed by pivoting the sink to the open position and placing the parts in the basket. The sink is closed to cover the cabinet compartment and the automatic cycle is initiated, causing cleaning solution to be sprayed from a manifold covering the parts in the cleaning basket.

BRIEF DESCRIPTION OF THE DRAWINGS

The above and other objects and advantages of the present invention will be more fully understood and appreciated from the following description, claims and drawings in which:

DETAILED DESCRIPTION OF THE DRAWINGS

Figure 1:
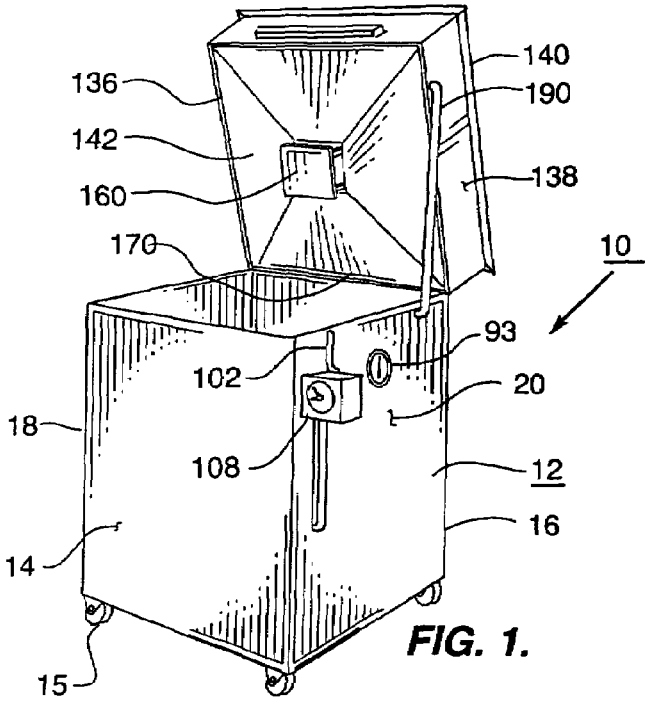
FIG. 1 is a perspective view of the parts cleaning apparatus of the present invention.
Figure 4A:
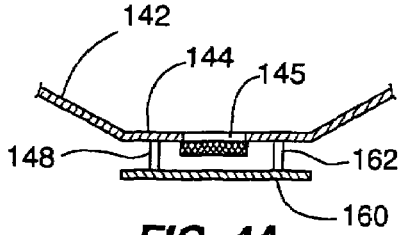
FIG. 4A is a cross-sectional detail of the sink drain.

Turning now to the drawings, the parts washer of the present invention is generally designated by the numeral 10 and includes a lower cabinet generally designated by the numeral 12. The lower cabinet is shown as being generally square or rectangular in horizontal cross-section having front wall 14, rear wall 16 and opposite sidewalls 18 and 20. It will be apparent that the cabinet may be other shapes such as round. The cabinet has a floor 22 and defines a chamber having jet cleaning chamber 25 in its upper end and a fluid reservoir 26 in its lower end. A vertical panel 28 extends between the front wall 14 and rear wall 16. The upper edges of the panel connect to a horizontal panel 30 which defines a mechanical enclosure 32 which is accessible through a vented access door 34 in the sidewall 18. The enclosure 32 may be located at any convenient location in the cabinet. The cabinet 12 may be fabricated from a suitable material such as a 12 gauge, rolled steel which is preferably insulated having a laminated insulative covering. A layer of fiberglass over the steel with a covering a sheet metal stitch-welded to the cabinets is a suitable material for this purpose. The cabinet is mounted on casters 15 for mobility.

Figure 2:
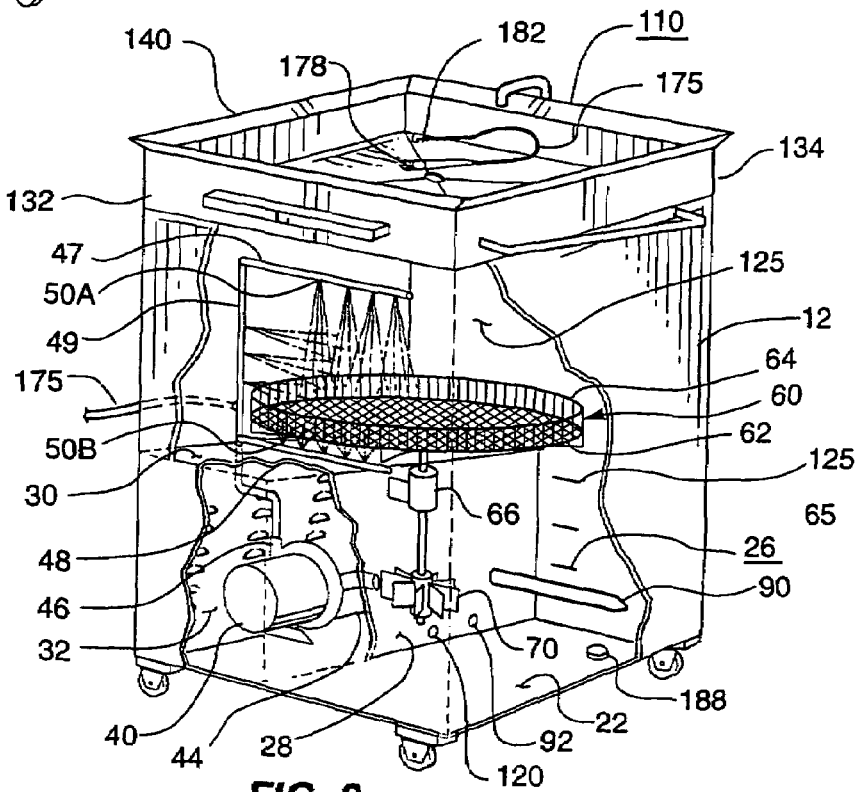
FIG. 2 is a perspective view similar to FIG. 1 partly broken away to illustrate the details of the invention.
Figure 4:
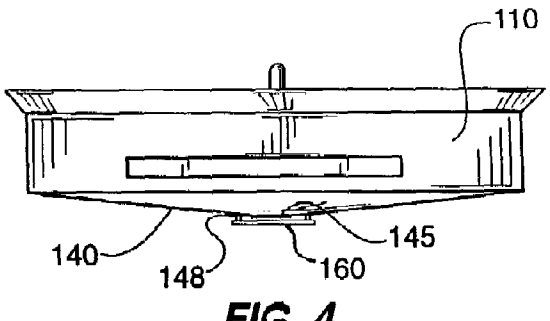
FIG. 4 is a front view of the sink portion of the parts cleaner.
Figure 3:
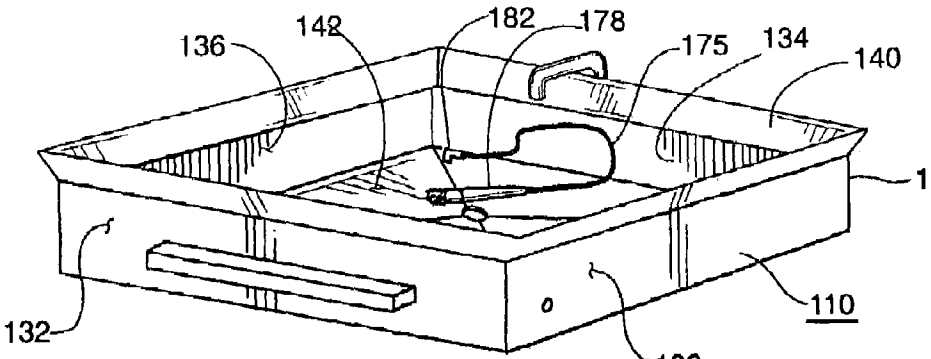
FIG. 3 is perspective view of the sink portion of the parts cleaning apparatus.

As best seen in FIG. 2, a pump 40 such as a pump of the type manufactured by Teel is mounted within the mechanical enclosure 32. The pump 40, typically ¾ to 1½ hp, has an inlet which communicates with the lower reservoir 26 via a conduit 44 in an opening in the vertical baffle 28. The pump discharge is connected to conduit 46 which extends vertically through the horizontal panel 30 along the sidewall 18. The conduit communicates with a spray manifold 50 having upper horizontal section 47, lower horizontal section 48 and vertical section 49. The horizontal sections 47, 48 extend at least half way across the interior of the cabinet. A plurality of orifices 50B are positioned at spaced-apart locations in the vertical manifold section 49. Similarly, a plurality of spaced-apart orifices 50A and 50C are disposed in the horizontal sections 47, 48 of the spray manifold 50 and are disposed to deliver a jet spray upwardly, downwardly and horizontally. The combination of the vertically disposed spray and the horizontal disposed spray patterns will provide a substantially full coverage to insure adequate cleaning of the parts on the parts basket 60 as it rotates with contained parts.

The parts basket 60 is shown as being generally circular with a bottom 62 and a peripheral sidewall 64 of steel mesh. Typically, the diameter of the basket is approximately 18" to 24." A shaft 65 depends downwardly from the center of the bottom 62 of the basket and is mounted in journal bearing 66 for rotation. Rotation to the basket is imparted by fluid flowing from the reservoir 26 into the pump inlet conduit 44. The conduit 44 is in close proximity to a plurality of vanes 70 arranged peripherally around the lower end of the shaft 65. The fluid flow passing the vanes induced by the suction of the pump will cause the shaft and basket to rotate.

In use, the reservoir in the cabinet contains a suitable cleaning solution such as a water-based, non-flammable, biodegradable detergent as manufactured by Golden West and sold under the trademark Insta-Clean MB5. The effectiveness of the cleaning solution is enhanced by heating a solution to a suitable temperature, as for example 150° F. Heating is accomplished by a heating element 90 which is shown as an electric resistance heating element that extends into the reservoir 26 at a location above the floor of the cabinet. A thermostat 92 is attached to wall 32 and the opening around the thermostat is sealed. The thermostat is connected to a source of electricity and controls the temperature of fluid within the reservoir.

Figure 6:
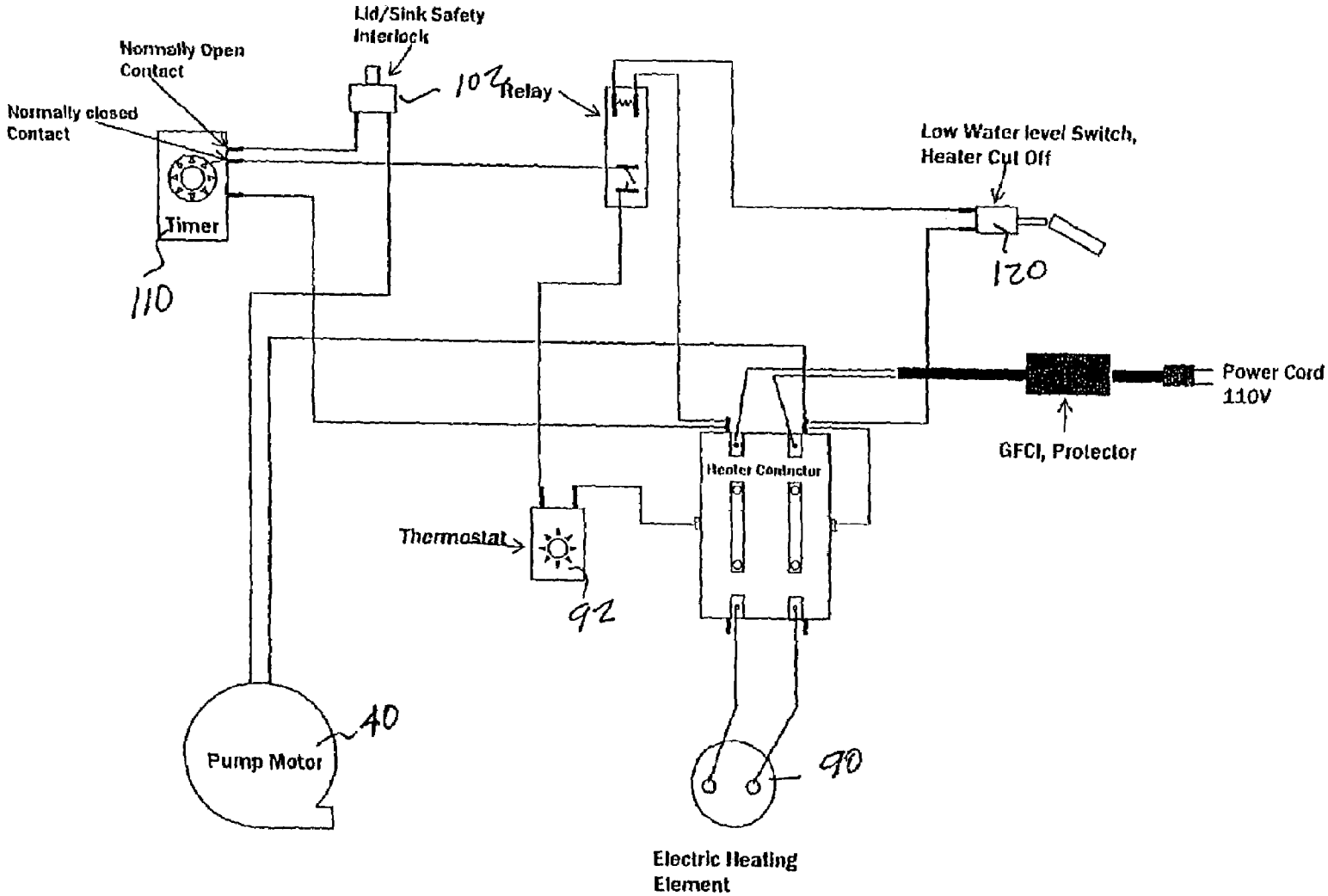
FIG. 6 is a schematic of the electrical system.

FIG. 6 is a schematic of the electrical components. The pump is connected to a source of power such as 110VAC across a ground fault interruptor. The pump is operable by means of a timer 110 having a safety interlock 102 which is moved to an operative position only when the sink is in a closed position. The timer 110 will energize the pump motor 40 for a predetermined period of time with 10 minutes being typical for most cleaning operations. The pump will withdraw heated washing fluid from the fluid reservoir 26 and direct it through the conduit 46 to the manifold 50 which discharges spray against the washing basket 60. When the timer 110 times out, the pump motor 40 will cease operation and can be restarted by restarting the timer. The thermostat is set at a suitable temperature as for example 150° F. A low fluid level sensor 120 will shut off the pump and heater if the fluid level drops below a minimum level. The fluid level may be visually checked by reference to the level indicator markings 125 on an interior wall of the cabinet.

Safety switch 102 is located on the side of the cabinet and will permit operation of the spray system only when the sink 110 is in the closed position shown in FIG. 2. The sink 110 is a parts washing sink and also serves as the lid or cover for the jet spray chamber within the cabinet. The sink has a front wall 132, rear wall 134 and opposite sidewalls 136, 138. The walls are dimensioned so that the lower edge of the sidewalls extend into the cabinet to fully enclose the chamber when in a closed position.

The sink sidewalls have a continuous circumferentially extending flange or lip 140 which extends outwardly and upwardly at about 25° from the horizontal to assist in containing fluid within the sink. The sink has a floor 142 and is inclined downwardly to a central section 144. The central section 144 defines a drain opening 145 which has a drain screen 148 to prevent small parts from falling through the drain. A horizontal baffle 160 is disposed below the drain suspended on vertically extending hangers 162 from the underside of the sink floor to deflect spray within the interior of the cabinet to prevent if from exiting the drain 145.

The rear wall of the sink is hinged to the rear wall of the cabinet by spaced-apart butt-welded hinges 170. The hinges allow the sink to be pivoted to the open position shown in FIG. 1 or returned to the closed position shown in FIG. 2. In the closed position, the lower edge of the sink rests on flange 172 extending around the interior of the cabinet below the upper edge.

Parts cleaning or washing fluid is directed to the sink through a flexible hose 175 which, at its distal end, terminates at a handle and brush assembly 178. The hose 175 is connected to the manifold 50 so that pump 40 provides a flow of pressurized cleaning solution to the brush. The brush may be metal or a synthetic material. In use, the mechanic may direct a regulated flow of cleaning solution through the brush by manual adjustment of flow control valve 182.

Items to be cleaned are placed in the sink or held over the sink and manually cleaned by brushing the parts using the brush. The flow of cleaning solution through the brush will assist in removing contaminants and will serve to flush the contaminants from the sink into the center drain. Small parts that are inadvertently dropped in the sink will be caught in the drain screen. Fluid and removed contaminants will flow through the drain to be collected in the reservoir. The rear of the sink may also be provided with a fixed nozzle 185 which may be operated to direct a stream of washing fluid on to the part or the item to be cleaned. The stream will flush away contaminants and allows hands-free operation as the part can be placed in the sink with cleaning fluid directed on to the parts. The reservoir 26 may be periodically drained and flushed at drain plug 188.

A suitable closer 190 extends between the sink sidewall 138 and the upper end and at sidewall 20 of the cabinet. Although only one closer is shown, two may be used. The closer serves to maintain the sink in the generally vertical, open position, as seen in FIG. 1, so that the mechanic may access the interior in order to place parts on the cleaning basket or remove them. The closer also will damper closing of the sink so that it slowly descends to the closed position as shown in FIG. 2 overlying the reservoir. The closer will also maintain the sink in a safe, open position when the washer is rolled from one location to another on the casters 15. The closer preferably is a gas spring damper for controlling the lowering of the sink at a controlled, constant speed such as manufactured by Suspa. As indicated, the reservoir contains a suitable cleaning solution such as a water-based, non-flammable, biodegradable detergent solution. The effectiveness of the solution is enhanced by heating the solution. The pump, when actuated, withdraws fluid from the reservoir and discharges it through the spray nozzles or through the manual brush or both.

As mentioned above, an important aspect of the present invention resides in the versatility of the device in that it can be used as an automatic jet washer, as well as a parts washer. When used as a jet washer, the sink will be pivoted to the open position as shown in FIG. 1 and parts to be cleaned can be placed on the parts basket 60. Once the sink is returned to the closed position, the safety interlock 102 will allow the user to actuate the pump causing fluid to be delivered to the manifold system and also causing the fluid impart rotation to the basket. Generally, the jet washing cycle will be set for a predetermined period of operation controlled by the timer, as for example 10 minutes. When the cleaning cycle is completed, the sink can be lifted to the open position to provide access to the interior chamber and the parts can be removed.

Fluid is delivered through hose 175 to the brush 178 from the manifold 50. Fluid and removed contaminants are removed from the sink by hand washing and will be discharged from the sink into the cabinet reservoir. It is not necessary for the user to place the parts to a separate sink such as the side-by-side sink of a conventional part washer. The design of the parts washer of the present invention is extremely versatile, compact and economical. The user is not required to buy three separate units as is often the case with conventional washers.

Further, the device is portable as the casters 15 allow the device to be easily transported to the area where the mechanic is working, as for example as is the case when a vehicle is on a lift and the mechanic is replacing brake parts and the brake components require cleaning. In this case, the sink can be positioned below the brake assembly. The brush can be applied to the brake parts on the vehicle and the fluid and contaminants collected in the sink and will flow into the sink and will flow into the cabinet.

Figure 5:
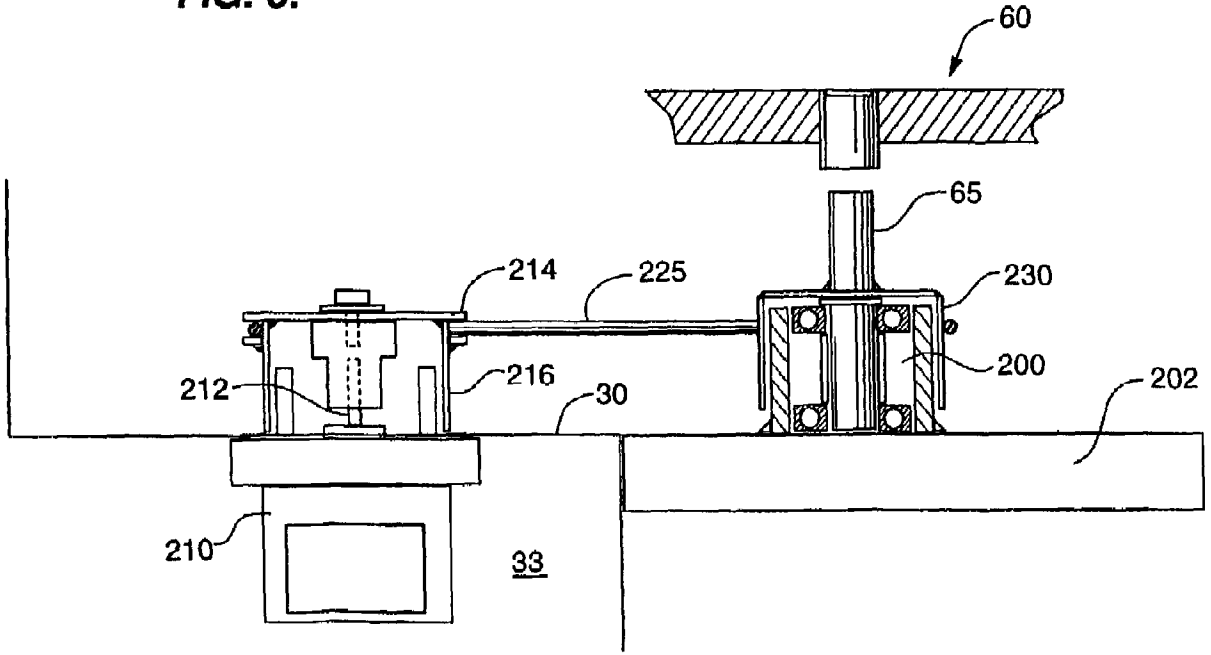
FIG. 5 is detail view illustrating an alternate drive assembly for the parts basket.
Figure 8:
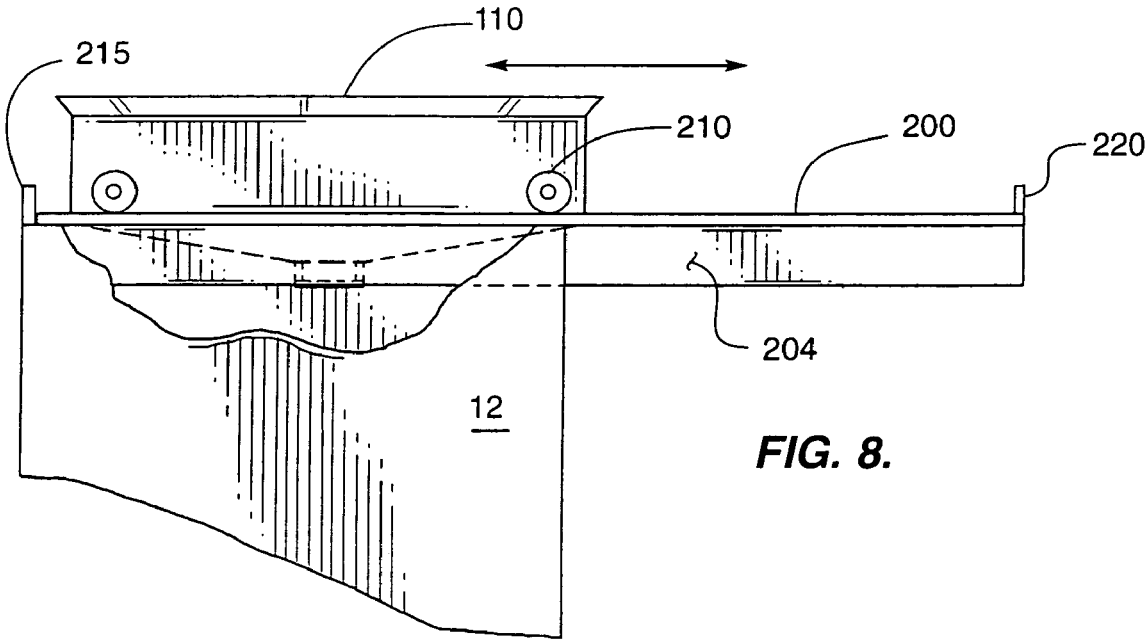
FIG. 8 is a front view of still another embodiment of the parts washer sink and cabinet.

FIG. 5 illustrates an alternate drive mechanism for the rotatable parts basket 60. In this case, basket 60 is supported on a bearing assembly 200 located on a support channel 202 extending from wall 28 of the enclosure 32. A gear motor 210, such as a fractional horse power gear motor is mounted within the mechanical enclosure having an output shaft 212 extending vertically through panel 30. The opening in the panel is suitably sealed. A pulley 214 is attached to the output shaft and may include a downwardly depending cup 216 to protect the shaft. An O-ring belt 225 extends from the pulley 214 to a cylindrical cup 230 secured to the lower end of the basket support shaft 65. The relative diameters of the gear motor spindle and the basket support pulley can be selected to provide the appropriate rotational speed for the basket. Typically, rotational speeds will be from approximately from 1 to 10 rpm. The O-ring belt is twisted into a FIG. 8 configuration to increase retention so it will not slip on the exterior of the cup 230. Actuation of the gear motor will drive the basket through the O-ring belt and pulley system.

Figure 7:
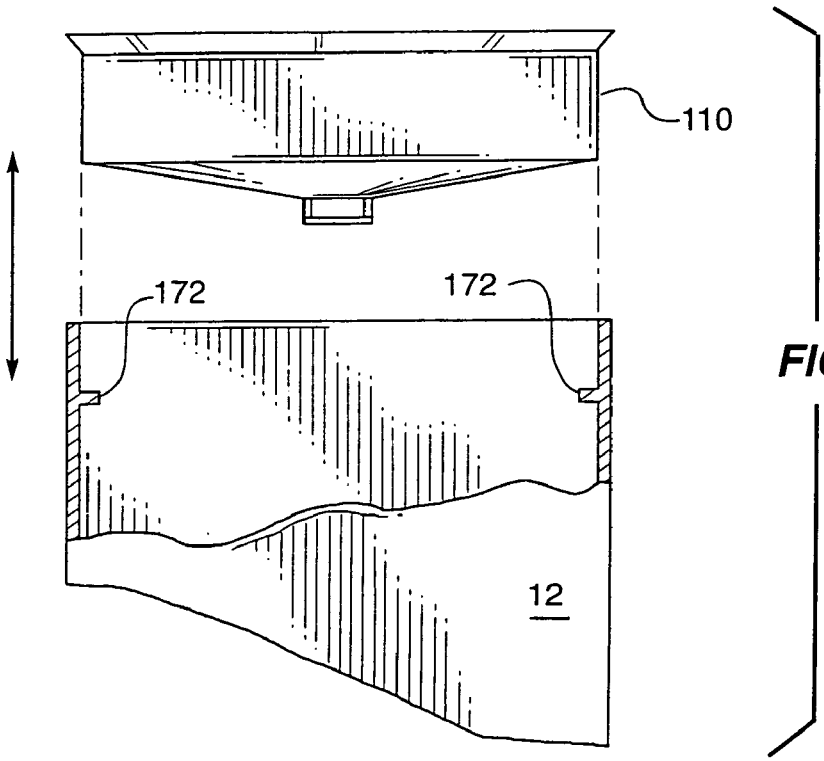
FIG. 7 is a front view of another embodiment of the sink and cabinet.

FIG. 7 shows another embodiment of the invention in which the sink 110 rests on flange 172 in the closed position. The sink 110 is a lift-off sink which may be removed to access the interior of the cabinet 12 or may be placed on the flange 172 to enclose or cover the jet washing chamber.

In FIG. 8, the sink 110 again has a closed position over the top of the cabinet. The sink 110 has rollers 210 which rest on guide rails 200 and may be slid rearwardly to an open position or moved forwardly to a closed position. Side panels 204 extend rearwardly to enclose the sink when in the forward position to prevent spray from exiting the cabinet. Stops 215 and 220 limit the travel of the sink.

It will be seen that the present invention provides a unique, efficient parts washer. Because of the compactness of design and its ability to be used as both a manual sink, an automatic jet washer and an undercarriage parts cleaner. As such, the washer of the present invention replaces several units in the shop area providing substantial economy to the shop operator. The washer is mobile and may be transported to a work location as beneath a lift or hoist to assist a mechanic working on a brake system. Both jet and manual cleaning can be accomplished at the same time with the same unit further increasing efficiency of the mechanic and increasing profitability.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. A portable multi-function parts washer for removing contaminants from parts either by hand or automatically using an aqueous cleaning fluid, said parts washer comprising:

(a) a base cabinet having sides and an open top defining a compartment having an upper jet cleaning section and a lower section;

(b) a cleaning receptacle mounted in said jet cleaning section for receiving parts to be washed by jet cleaning;

(c) a spray manifold in said jet cleaning section having at least one spray nozzle oriented to direct a cleaning spray toward said receptacle;

(d) a fluid pump having an outlet and an inlet;

(e) a sink mounted on said cabinet open top overlying said jet cleaning section having a closed position closing said cabinet open top and an open position providing access to said jet cleaning section to load and remove parts therefrom;

(f) a hand washer for manually cleaning parts in the sink;

(g) a drain in said sink;

(h) a fluid reservoir in the lower section of said cabinet receiving the fluid discharged from said sink through said drain and receiving the fluid discharged from said jet cleaning section; and (i) said pump inlet in fluid communication with said reservoir and having its outlet in fluid communication with said manifold and said washer to supply pressurized cleaning fluid to said hand washer and said spray manifold exclusively from said reservoir independent of any external fluid supply.

2. The combination sink and jet parts washer of claim 1 wherein said sink is hinged to said base cabinet.

3. The combination sink and jet parts washer of claim 1 wherein said sink is removably seated on said cabinet.

4. The combination sink and jet parts washer of claim 1 wherein said sink is on guide means and is slidable between said open and closed positions.

5. The combination sink and jet parts washer of claim 1 wherein said hand washer includes a brush and a valve to regulate the fluid flow.

6. The combination sink and jet parts washer of claim 1 wherein a dampening closer extends between said sink and cabinet.

7. The combination sink and jet parts washer of claim 6 wherein said closer is a gas spring.

8. The combination sink and jet parts washer of claim 1 further including means for rotating said receptacle comprising vane means attached to said basket positioned to be driven by fluid flow to said pump.

9. The combination sink and jet parts washer of claim 1 including means for rotating said receptacle comprising a gear motor and pulley.

10. The combination sink and jet parts washer of claim 1 wherein said pump is driven by an electric motor in a circuit having a safety interlock permitting operation of the motor only when the sink is in a closed position.

11. The combination sink and jet parts washer of claim 1 wherein said circuit is connected to an electrical heater located in the reservoir.

12. The combination sink and jet parts washer of claim 1 wherein said sink is generally rectangular having sidewalls which terminate at an upwardly flared flange.

* * * * *